United States Patent [19]

Nagy

[11] Patent Number: 4,577,418

[45] Date of Patent: Mar. 25, 1986

[54] SHOE PROTECTOR

[76] Inventor: Charles E. Nagy, 500-B N. Louise St., Glendale, Calif. 91206

[21] Appl. No.: 555,493

[22] Filed: Nov. 28, 1983

[51] Int. Cl.[4] ..... A43B 13/22

[52] U.S. Cl. ..... 36/72 B; 36/51; 2/DIG. 6

[58] Field of Search ..... 36/72 R, 72 B, 71.5, 36/83, 73, 51, 50; 2/DIG. 6

[56] References Cited

U.S. PATENT DOCUMENTS

| | | | |
|---|---|---|---|
| 913,012 | 2/1909 | Jackson | 36/51 |
| 1,595,630 | 8/1926 | Stockton | 36/51 X |
| 3,104,479 | 9/1963 | D'Amico | 2/DIG. 6 |
| 4,249,321 | 2/1981 | Nagy | 36/72 B |

FOREIGN PATENT DOCUMENTS

| | | | |
|---|---|---|---|
| 221406 | 5/1909 | Fed. Rep. of Germany | 36/51 |
| 2375841 | 9/1978 | France | 2/DIG. 6 |
| 2118427 | 11/1983 | United Kingdom | 36/72 B |

*Primary Examiner*—Werner H. Schroeder
*Assistant Examiner*—T. Graveline
*Attorney, Agent, or Firm*—Frank L. Zugelter

[57] ABSTRACT

A construction, comfortably, quickly and easily securing and releasing a protector about and from the rear upper and heel portions of a shoe. The protector comprises a bonnet which wraps around heel and rear upper portions of a wearer's shoe. An elongated flap member is disposed above and across the foot's dorsal area. A VELCRO strip (loops) most of which being securely mounted topside of such member, is affixed at its one end to a corner of an upper frontal portion of one side panel of the bonnet. One end of another VELCRO strip (hooks) is attached to an opposing end of the elongated member, its length threaded through a noose attached at a corner of an upper frontal portion of the other side panel of the bonnet. A pull tab attached to the VELCRO strip (hooks) cooperates with the noose to prevent such strip from being freed of the noose, yet the strip's length provides ample play by which the shoe is inserted under it. The VELCRO strip (hooks) is reversed in its direction at the noose after such play is removed so that the two VELCRO strips mate and lock, thereby releasably attaching them together to snugly maintain the protector in place on the shoe. An alternative embodiment encompasses a flexible, expandable hollow convoluted cylinder freely mounted around an elastic strap secured across the front corners of the bonnet's side panels.

9 Claims, 7 Drawing Figures

SHOE PROTECTOR

TECHNICAL FIELD

This invention relates to shoes and in particular, to a protector for its rear upper and heel portions whereby wearing of it prevents scuffing or other damage to such shoe portions of its wearer.

BACKGROUND ART

Disclosures of various kinds of shoe protectors are found in the following numbered U.S. Pat. Nos.: 1,820,679; 2,988,830; 3,006,427; 3,104,479; 3,217,430; and 4,249,321, obtained through a novelty search prior to seeking this patent. Also, a company, Lois Woodbridge Advertising, 1620 South Clementine, Anaheim, Ca. 92802, sells a terry cloth shoe protector, which looks like an enlarged coin purse in silhouette. Basically it merely is a wrap-around type of article for the rear of a shoe, with less than two-inch companion Velcro-material strips closing its sides or edges upon the dorsal area of the foot or shoe.

DISCLOSURE OF THE INVENTION

This invention is directed to an article of manufacture to fit the rear upper and heel portions of a shoe worned by an operator of a vehicle, while the front end of the shoe or shoes is utilized to operate motion of the vehicle. Example of such an operation are operations of a car, a motor boat, an airplane, etc.

Shoes are expensive, and notice of the condition of a wearer's shoes is very apparent. As noticeable as a beautifully-kept shoe is a scuffed or damaged shoe, particularly on its rear upper and heel portions.

Furthermore, commuting via roadways and private planes is more frequent today in our mobile society, with longer times required for the operation of a vehicle travelling to and from different geographical points. Driving necessitates continued movement of the foot as a matter of maintaining comfortability as well as repositioning between an accelerator and brake pedals. In an airplane, rudder and elevator controls require movements of both feet (shoes) thereon. These movements materialize into abrasive action on exterior portions of the shoe, particularly, on its rear upper and heel portions. As a consequence, good looking shoes without any protection during vehicle operation become unsightly afterwards.

The heel protector comprises a bonnet which envelopes or wraps around heel and rear or upper portions of a wearer's shoe. An elongated member is or strap disposed above and across the foot's dorsal area. A VELCRO strip (having loops) is securely mounted top side of such member, with a portion in tandem and secured at a corner of an upper front portion of a side panel of the bonnet. One end of another VELCRO strip (having "hooks") is attached to an opposing end of the elongated member and is threaded through a noose attached at a corner of an upper frontal portion of the other side panel of the bonnet. A pull tab is attached to the terminal end of the Velcro strip (hooks) for cooperation with the noose to prevent escape of such strip from the noose and yet provide ample play of its length under which the shoe is inserted. The direction of the VELCRO strip (hooks) is reversed in its direction at the noose so that the companion Velcro strips are mated, thereby releasably attaching them together to maintain the protector in place on the shoe. An alternative embodiment encompasses a flexible, expandable, convoluted hollow cylinder freely mounted around an elastic band secured to the spaced corners of the upper frontal portions of the bonnet's side panels, whereby ease of application of the protector to the shoe and comfortability to the foot's dorsal area are achieved.

It is an object of the invention to eliminate abrasion, scuffing, cuts and the like from a shoe's rear upper and heel portions, thereby retaining its good looks by the protection of the heel bonnet.

Another object of the invention is to remove the awkwardness and tediousness of application to and removal from the shoe that is associated with present day state-of-the-art shoe protectors, and to provide ease of application to and removal from the shoe with the protector.

Another object of this invention is to prevent tightening, pinching or restricting upon the dorsal area of the foot by the protector as it is applied and/or worn.

Another object of this invention is to provide a novel construction for confortably maintaining a protector in proper position on and about a shoe.

Another object of the invention is to provide a simple and quick introduction to and removal from a shoe.

Another object of the invention is to maintain comfortable tactile feeling upon the dorsal area of the foot as a protector is worn elsewhere in its proper position about a shoe.

Another object of the invention is to provide a convenient open condition for the article preparatory to slipping it on to and over a shoe toe.

These and other objects and advantages will become more apparent upon a complete reading of the following description, the appended claims thereto, and the sheet of drawing illustrating embodiments of the invention.

BRIEF DESCRIPTION OF THE DRAWING

FIG. 5 is a perspective view of the invention including a feature protecting a high heel or the like.

BEST MODE FOR CARRYING OUT THE INVENTION

Figure 1:
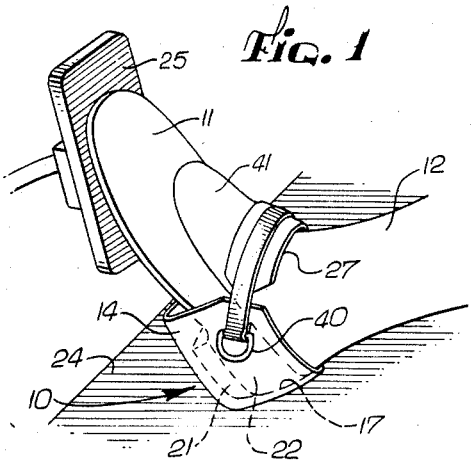
FIG. 1 is a perspective view of the invention worn in place about a shoe as the latter is positioned on an accelerator pedal in a vehicle.
Figure 2:
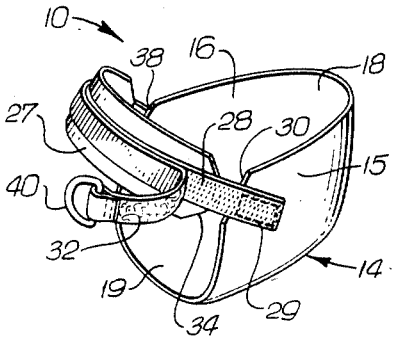
FIG. 2 is perspective view of the invention, with shoe removed therefrom but as if properly mounted about the shoe, and in a stage of opening or closing upon a shoe (not shown).

Referring now to the drawing wherein reference characters refer to like numerals hereinafter, FIG. 1 shows application of the invention in a protector 10 to a shoe 11 of its wearer 12. Protector 10 comprises a bonnet member 14 having a pair of side panel members 15, 16 [FIG. 2] disposed in opposing relation to each other in order to accommodate the introduction of the width of the rear end 17 of shoe 11. Side panel members 15, 16 converge into a curving rear panel 18, all of which are joined together with a base panel 19.

Rear panel 18 and base panel 19 accomodate, respectively, the rear 17 and a heel 21 proper (in phantom, FIG. 1) to shoe 11 itself. It will be apparent that heel 21, rear 17, and upper rear portions 22 (only one shown in phantom in FIG. 1) of shoe 11 are fully protected by the hugging, enveloping protector 10, as shoe 11 tosses, turns and scoots about a floor board 24 or the like as the wearer 12 of shoe 11 operates a pedal 25 or the like part and parcel of the vehicle being manuevered by wearer 12.

A dorsal-area seeking member 27, elongated in one dimension and preferably flat and of flexible nature, is adapted to be situated across the foot's dorsal area, and is in direct contact therewith in the actual wearing of protector 10. A first strip 28 of companion VELCRO materials, preferably containing the hooks of such material, is fastened, such as by stitches 29, at its one end to a side panel 15 adjacent an upper frontal corner 30 at the top of bonnet member 14. VELCRO strip 28 extends from corner 30 in parallel fashion to the elongated dimension of flap member 27, with some of its length being securely attached, as by stitching, to the top side of member 27, FIG. 3. The loops of strip 28 face away from member 27 and from the pocket formed in protector 10 for the wearer's shoe. A second Velcro strip 32 containing loops which mate with the hooks of complementing VELCRO strip 28 has it one end attached, such a by stitches 33 [FIG. 4], to the end of flat member 27 opposing its other end 34, FIG. 3. VELCRO strip 32 extends from such attached end through a noose 37, preferably in the form of a metal buckle, securely mounted adjacent the corner 38 of side panel 16, FIG. 4. Its other terminal end is suitably fastened to a finger pull 40. Finger pull 40 may be formed of the VELCRO material itself. Further, as shown here, its dimensions can be of a size which does not pass through noose 37 in any manner.

Figure 4:
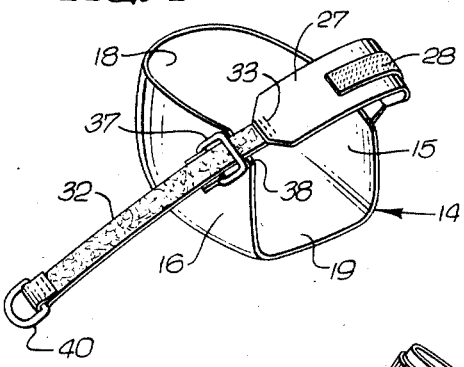
FIG. 4 is a view from the opposite side of the article shown in FIG. 3.
Figure 3:
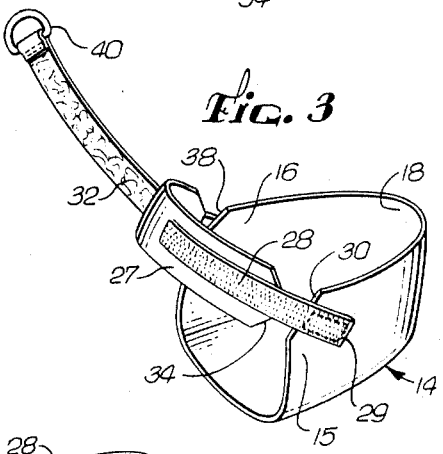
FIG. 3 is perspective view of the invention in another stage of opening or closing upon a shoe.

It is to be observed from FIGS. 3, 4 that the looped and hooked sides of the respective VELCRO material strips 28, 32 do not face bonnet member 14 in their extended positions shown in these FIGURES. Further, the length of the element 32, all of which need not be made of VELCRO material, is preferably substantially equal to the tandem length of the dorsal seeking member 27 and VELCRO strip 28. And it is important to note that the lengths of strips 28, 32 are to be sufficiently long in relation to one another and in relative dispositions in their mating relationship that such mating does occur regardless of the size of foot and/or shoe.

Figure 5:
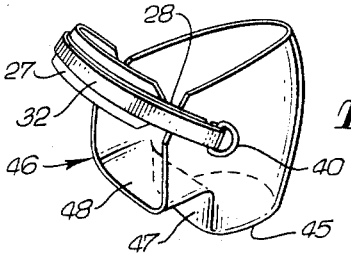

FIG. 5 exemplifies an additional feature shown as element 45 forming a portion of a bonnet 46. Bonnet 46 includes the configuration 45 for a woman's high heel on her shoe, rather than having a base panel 19 provided for enveloping in a flat manner a usual type of heel 21 for a low-heeled shoe. Configuration 45 includes side, rear and base panels similar to those included in bonnet 14, as well as a frontal panel 47. Panel 47 depends from a base panel 48 adapted to conform to an under side or in-step portion of a high-heeled shoe immediately in front of the high heel of such shoe. The side and rear panels of bonnet 46 and a base panel (not referenced) join with panel 47 to constitute configuration 45. Such panels are designed or fitted to conform to configuration 45 for narrow or high heels on shoes.

Figure 6:
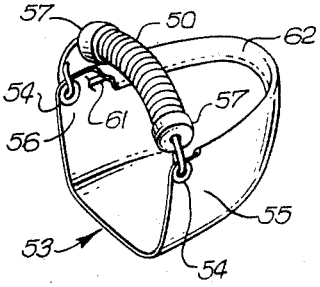
FIG. 6 is a perspective view of another embodiment of the invention.
Figure 7:
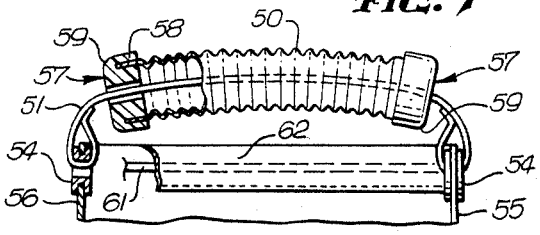
FIG. 7 is an elevational view, partly in cross section, of a convoluted hollow member utilized in the embodiment of FIGS. 7 and 6.

FIGS. 6 and 7 disclose another embodiment of the invention. A convoluted or bellows-like hollow cylindrical member 50 circumscribes and is freely mounted upon an elastic strap band or braid 51 securely attached across the open pocket for a bonnet 53. Strap 51 is attached to metal eyelets 54 secured to upper forward corner portions of side panels 55, 56 of bonnet 53. The convoluted member 50 comprises an integrally molded plastic convoluted element of a length sufficiently long to enclose substantially the entire length of elastic strap or braid 51. A flexible plastic or rubber bushing 57 or the like, preferably incorporating a flap 58 in engagement with each end of convoluted member 50, caps each end of member 50. Each bushing 57 provides an exposed curved radius 59 which will comfortably impinge against the dorsal area of the foot of the wearer, to prevent snagging of socks or stockings. Each bushing 57 includes a centrally located aperture through which elastic strap 51 freely passes for fastening around a corresponding eyelet 54, such as by stitching a looped end around it.

Further, an elastic band 61 is suitably provided in a hem 62 stitched around the top terminus of bonnet 53. The ends of elastic band 61 are likewise suitably attached to their corresponding eyelets 54. Elastic band 61 provides the snugness between bonnet 53 and shoe, which in the embodiment of FIGS. 1–4, is provided by the take-up or mating of the Velcro strips 28, 32.

In operation, protector 10 is placed in a physical condition such as shown in FIG. 4, after which dorsal-seeking member 27 is manually pulled away from noose 37 until finger pull 40 is stipped by noose 37. The length of shoe 11 is quickly, readily and easily slipped into the entrance of and into the open pocket formed by spaced side panels 15, 16, rear pannel 18 and base panel 19, and behind VELCRO strip 32 juxtapositioned to such open pocket. Bonnet 14 is urged to wrap and hug itself around the shoe elements 17, 21, 22 as shown in FIG. 1. Immediately, finger pull 40 is swiftly pulled away from noose 37, FIGS. 3, 4, thereby positioning the elongated dimension of flap member 27 across the dorsal area 41 [FIG. 1] of the wearer's foot. Its direction of pull is then reversed, against noose 37, so as to be drawn over such elongated dimension of flap member 27. A substantial portion of the VELCRO strip on element 32 then is mated with a substantial portion of VELCRO strip 28, FIGS. 1, 2, in order to obtain a snug fit of flap member 27 across the foot's dorsal area 41 and a hugging of protector 10 to shoe 11 around its rear and heel results.

For removal of protector 10 from shoe 11, finger pull 40 is manually grasped in a way to release the mated companion VELCRO materials 28, 32 from one another, so that such strips or materials 28, 32 achieve their positions shown in FIGS. 3, 4. Dorsal flap member 27 then is fingered to remove it from direct contact with the dorsal area of the foot, until pull 40 engages noose 37. There then is ample room for shoe 11 to be withdrawn or pulled from protector 10. Device 10 can remain on floor 24 of the vehicle adjacent its accelerator pedal 25 for use at some future time once again.

The separation and removal of protector 10 above is basically the same for the embodiment disclosed in FIG. 5. In regard to the embodiment of FIGS. 6, 7, convoluted member 50 is grasped and pulled away from the open pocket formed in bonnet 53, to either insert or remove the length of a shoe 11 to in between such member 50 and such pocket. The heel and rear portions of shoe 11 are urged to conform to such pocket upon application of protector 10 to shoe 11, and bonnet 56 is removed from such portions in taking it off of shoe 11, as the grasping and pulling of convoluted member 50 stretches elastic band 51 to a position remote from the dorsal area of a foot 41 to gain such removal.

Material contemplated for member 50 is a plastic material purchaseable at Installation Supply Company, 1901 Harpers Way, Torrance, Ca., under the trade name ICORE, catalogue number XCC209. This is a commercial grade of material, however, military specifications are available on member 50. Member 50 preferably is of $\frac{5}{8}$ inch outer diameter, and when worn across the dorsal area of the foot, provides for a comfortable feeling as contrasted to a restrictive or otherwise irritating tactile sense which an elastic band is known for in its direct contact with the dorsal area or skin of the wearer in general.

The bonnets are made from a flexible, water-proof wear-resistent material, such as vinyl, nahauganide, or leather, although other suitable material, such as cotton or terry cloth, may be used. Each bonnet preferably includes a liner of cloth for seating upon leather or other quality material from which shoe 11 is made. VELCRO material of which strips 28, 32 are made is well known in the marketplace and readily adaptable for attachment to flap member 27 which itself is formed from suitable material such as leather, for example. The finger pull 40 and noose or buckle 37 are suitably formed from metal in known manner and are readily connected to their corresponding elements in known manner.

The assembling of the variously described elements above, in the embodiments of FIGS. 1–4 and 5, is accomplished in known manner. Each of the bonnet members may be formed by sewing together cuts of material, after which a sewn flap 27 and VELCRO-strip 28 are attached as at 29 adjacent corner 30. After noose 37 is sewn to a bonnet adjacent its corner 38, the end of VELCRO strip 42 is passed therethrough and suitably attached at 33 to flap member 27. Finger pull 40 may be attached to strip 32 at any time.

In the embodiment of FIGS. 6, 7, a length of an elastic band 51 is first threaded through convoluted member 50, which previously had suitably attached to its ends its apertured bushings 56. Thereafter the ends of band 51 are attached to bonnet 53 with eyelets or gussets 54, at the frontal upper and opposing portions of bonnet 53.

Various changes or modifications in the embodiments may be made without changing the spirit or scope of the invention. For example, strip 28 need not extend completely to and be part of stitching 29 (FIG. 3), as long as a suitable length of such strip 28 is available for mating with a suitable length of its companion strip 32 to maintain a good locking condition during the wearing of device 10. Also, such strips may be of a sufficient or suitable length in a design manufactured to accomodate any size and style of or to accomodate a great or small number of styles or sizes of shoes, as long as their mating maintains a good locking condition. Convoluted member 50 need not be freely mounted about band 51 or bonnet 53. A cloth liner (not shown) may be included within and suitably attached to the inside walls of the bonnet's panels.

What I claim as patentably distinct is:

1. In a device for protecting heel and rear portions of a shoe, and including a bonnet with a pocket for a snug fit about such portions, said bonnet having opposing upper frontal corners thereon, the improvement comprising a non-folded elongated member extending between its ends substantially across and in front of such pocket, for mounting across the dorsal area of a foot in a shoe to which said device is adapted, companion VELCRO-material first and second strips, the first strip securely mounted in top relationship to said non-folded member, said first strip extending beyond the member's one end and attached to the first of the opposing upper frontal corners, the second strip having a first end attached to the other end of said non-folded member, the second end of said second strip extending away from said member, and a noose secured to a second one of said opposing upper frontal corners, said second strip extending through said noose, said second strip reversible in direction against said noose to mate and lock with its companion first strip.

2. In the device of claim 1, a pull tab secured to said second strip and being of a size incapable of passing through said noose.

3. In the device of claim 1, a pull tab secured to said second strip and being of a size incapable of passing through said noose.

4. A protector for eliminating scuffing of a shoe in its heel and upper rear portion areas as the shoe seats on a vehicle's floor behind a pedal, comprising a flexible, waterproof, wear-resistent bonnet, the bonnet having a body being sufficiently extant to form a pocket to envelop heel and upper rear portions of a shoe clear around and under its heel and including opposing upper frontal corners, a non-folded elongated member disposed across such pocket, companion VELCRO-material first and second strips, the first strip attached atop said non-folded member and to said bonnet adjacent a first one of said opposing upper frontal corners, a first end of the second strip being attached to another end of said non-folded member, a noose secured to a second one of said opposing upper frontal corners, a second end of said second strip extending through said noose, said second strip reversible in direction against said noose to mate and lock with its companion first strip.

5. The protector of claim 4 including a pull tab secured to said second strip and being of a size incapable of passing through said noose.

6. The protector of claim 4 including a pull tab secured to said second strip and being of a size incapable of passing through said noose.

7. In a device for protecting heel and rear portions of a shoe, and including a bonnet for a snug fit about such portions, said bonnet having opposing upper frontal corners thereon, and an elastic band having ends each being secured to one of said opposing upper frontal corners, the improvement comprising a hollow expandable convoluted plastic member mounted on said elastic band, a bushing securely mounted at each end of and to said hollow convoluted member, each said bushing having an aperture therethrough for passage of said band, an exposed radiused annular edge included in each said bushing, said member adapted to comfortably engage the dorsal area of a foot about which a shoe and said device thereon is mounted.

8. In the device of claim 7 said hollow member being freely mounted about said band.

9. In combination with the improvement of claim 7, a second elastic band mounted to the bonnet around its top terminus and having ends each of which respectively is secured at a corresponding upper frontal corner of the bonnet.

* * * * *

Disclaimer 4,577,418.—*Charles E. Nagy,* Glendale, Calif. SHOE PROTECTOR. Patent dated Mar. 25, 1986. Disclaimer filed Apr. 7, 1986, by the *inventor.*

Hereby enters this disclaimer to claims 2 and 5 of said patent.

[*Official Gazette July 1, 1986.*]